US008579194B2

(12) United States Patent
Boss et al.

(10) Patent No.: US 8,579,194 B2
(45) Date of Patent: Nov. 12, 2013

(54) METHOD FOR OPTIMISING THE FIRING TRIGGER OF A WEAPON OR ARTILLERY

(75) Inventors: André Boss, Zürich (CH); Karel Vit, Gossau (DE)

(73) Assignee: Rheinmetall Air Defence AG, Zürich (CH)

( * ) Notice: Subject to any disclaimer, the term of this patent is extended or adjusted under 35 U.S.C. 154(b) by 854 days.

(21) Appl. No.: 11/991,229

(22) PCT Filed: Jul. 20, 2006

(86) PCT No.: PCT/EP2006/007128

§ 371 (c)(1),
(2), (4) Date: Mar. 18, 2009

(87) PCT Pub. No.: WO2007/028455

PCT Pub. Date: Mar. 15, 2007

(65) Prior Publication Data

US 2009/0218400 A1 Sep. 3, 2009

(30) Foreign Application Priority Data

Sep. 2, 2005 (DE) ..... 10 2005 041 704

(51) Int. Cl.
*G06G 7/80* (2006.01)

(52) U.S. Cl.
USPC ..... 235/412; 235/404

(58) Field of Classification Search
USPC ..... 235/404, 412
See application file for complete search history.

(56) References Cited

U.S. PATENT DOCUMENTS

| | | | | |
|---|---|---|---|---|
| 4,308,015 | A | 12/1981 | Tye | |
| 4,577,962 | A | 3/1986 | Guillenschmidt et al. | |
| 4,794,235 | A * | 12/1988 | Burke et al. | 235/412 |
| 6,776,336 | B2 * | 8/2004 | Bowen | 235/412 |

FOREIGN PATENT DOCUMENTS

| | | |
|---|---|---|
| CH | 474738 | 8/1969 |
| CH | 650857 | 8/1985 |
| CH | 691143 | 4/2001 |
| DE | 1165459 | 3/1964 |
| EP | 0105432 | 4/1984 |

* cited by examiner

*Primary Examiner* — Daniel Hess
(74) *Attorney, Agent, or Firm* — Lucas & Mercanti, LLP; Klaus P. Stoffel

(57) ABSTRACT

The invention relates to a method for determining a favourable moment for triggering the firing of a weapon on a moving target. According to said method, firing commands and expected impact points (P1-P3) of a projectile and the target (2) are calculated with the aid of an algorithm, without actually triggering a firing burst. The target (2) is selected, the algorithm is activated and hypothetical data is determined. The process is aided by a graphical display (4) of the data. In the preferred embodiments, additional information is taken into account and/or is visualised for a user (5).

8 Claims, 3 Drawing Sheets

METHOD FOR OPTIMISING THE FIRING TRIGGER OF A WEAPON OR ARTILLERY

This is a U.S. National Stage of application No. PCT/EP2006/007128, filed on Jul. 20, 2006. Priority is claimed on that application and on the following application:

Country: Germany, Application No.: 10 2005 041 704.3 Filed: Sept. 2, 2005.

BACKGROUND OF THE INVENTION

When attacking targets, firing commands, that is to say the launch angle and the instance of shot firing are chosen in order to achieve as high a hit probability as possible. The accuracy of weapon aiming, the munitions scatter and the atmospheric influences make this task harder. In order to counteract these disturbances, measures are taken, such as calibration during the aiming procedure or measurement of the air pressure and air temperature and wind. Furthermore, another factor is the variability of the muzzle velocity, which influences the time of flight of the projectile to the target. In practice, the muzzle velocity of the projectile is therefore often measured, and is taken into account in the fire control. For example, CH 691 143 A5 discloses an apparatus for measuring the projectile velocity at the muzzle of a weapon barrel. This comprises two sensors which are arranged at a distance from one another on a supporting tube, respond to a change in a magnetic flux, and are connected to evaluation electronics.

Additional error sources are, in particular, the unknown target movements between the time of firing the projectile and its arrival at the target. Particularly if the projectile has to fly over relatively long distances, it may be difficult to predetermine the predicted position of the target at the hit point. In order to reduce these errors, models of the target movement are formulated and are operated using target measurement data in order to identify the kinematics of the target. This data is then used, in general extrapolated, in the fire control in order to predict the target position after the expected time of flight.

However, with the exception of the radial velocity, the measurements are pure determined positions. The target velocity and, possibly, target acceleration are derived from these in the filter, and are used for the extrapolation. The accuracy of the extrapolated data is particularly dependent on the quality of the acceleration estimate. Furthermore, as soon as the target maneuvers and the accelerations become large for this reason, it is possible for the fire control to refuse the firing recommendation. The known residues of the filter, that is to say the difference between the estimate and the measurement, are therefore not very suitable for this purpose, because they include only the position error with respect to the target. In the event of a target maneuver, a certain amount of time always passes before the filter transforms the generated residues to acceleration. This is referred to as stabilization of the filter.

The total time delay between the target maneuver and the time of arrival of the projectile, whose fire elements take account of this maneuver, at the target is composed of:

time delay=stabilization of the filter+time of flight of the projectile+other dead times.

In this case, other dead times means the time required for the measurement, for the data processing and for data transmission.

The fire control is improved by test projectiles or trial firings, and this can be referred to as a "closed loop". In order to statistically improve the measurement results of the test projectiles, a limited number of them are fired successively. A firing burst whose first shots are measured at the target must in this case last longer than the projectile time of flight if its last shots are to profit from the corresponding corrections. Measurement systems such as these are complicated, and furthermore expensive, depending on the purpose.

SUMMARY OF THE INVENTION

In this case, the invention is based on the object of specifying a method which helps an operator to choose a favorable firing burst, particularly during target maneuvers.

The invention is based on the idea of using a known computation algorithm from an actual firing in order to determine the best moment for firing initiation at moving targets, but not of actually initiating the firing command in the process. This is done on a purely hypothetical basis. Data is determined and used by continuous calculation and collection of the firing commands and of the predicted hit points associated with them.

The method is therefore based on calculating the firing commands and the expected hit point without, however, actually initiating firing. The target is searched for, the algorithm is applied, and everything else is calculated hypothetically. In this case the algorithm may also include control of the gun as the basis for the firing command.

After the time of flight of the hypothetical projectile, as calculated in this way, the actual target position is determined and the miss distance between the target and the previously calculated hit point is calculated. This gives an indication of how accurate the shot would have been. This information is admittedly delayed by the time of flight, but it can be generated continuously and can provide important information about the behavior of the hit probability to be expected.

For example, the error at the target may be the minimum distance between the trajectories of the projectile and the target. If the time at the target is also relevant, for example in the case of breaking-up projectiles or grenades with a time fuze the distance between the two at the time of breakup is the governing factor. Alternatively, angle errors may be considered. A suitable combination of various error definitions is also feasible, but the result is advantageously described by a scalable variable.

Displays with visible development of the errors are preferred, for example graphics curves over the time which corresponds to the correlation time of the response, since the data is intended to provide information not only about the instantaneous error but is mainly intended to allow an estimate of its response in the near future. For this purpose, the operator is presented preferably likewise via a display not only with the hypothetical data but with current or quasi-current additional data. If the method is automated, a software provision can be provided in the algorithm, in which case the graphics display can be retained.

The method therefore results in a suitable measure of the hit errors as soon as the target approaches the hit point as calculated in advance. The calculated measure of the hit errors is displayed graphically, is continuously updated, and is additionally made available to the operator and/or the algorithm. The firing commands are not corrected and, in fact, without any complex measurement in the target region, the operator is provided with a method/a display to assist him in the choice of the best moment to initiate firing.

The invention will be explained in more detail using one exemplary embodiment and in conjunction with the drawing, in which:

DETAILED DESCRIPTION OF THE INVENTION

Figure 1:
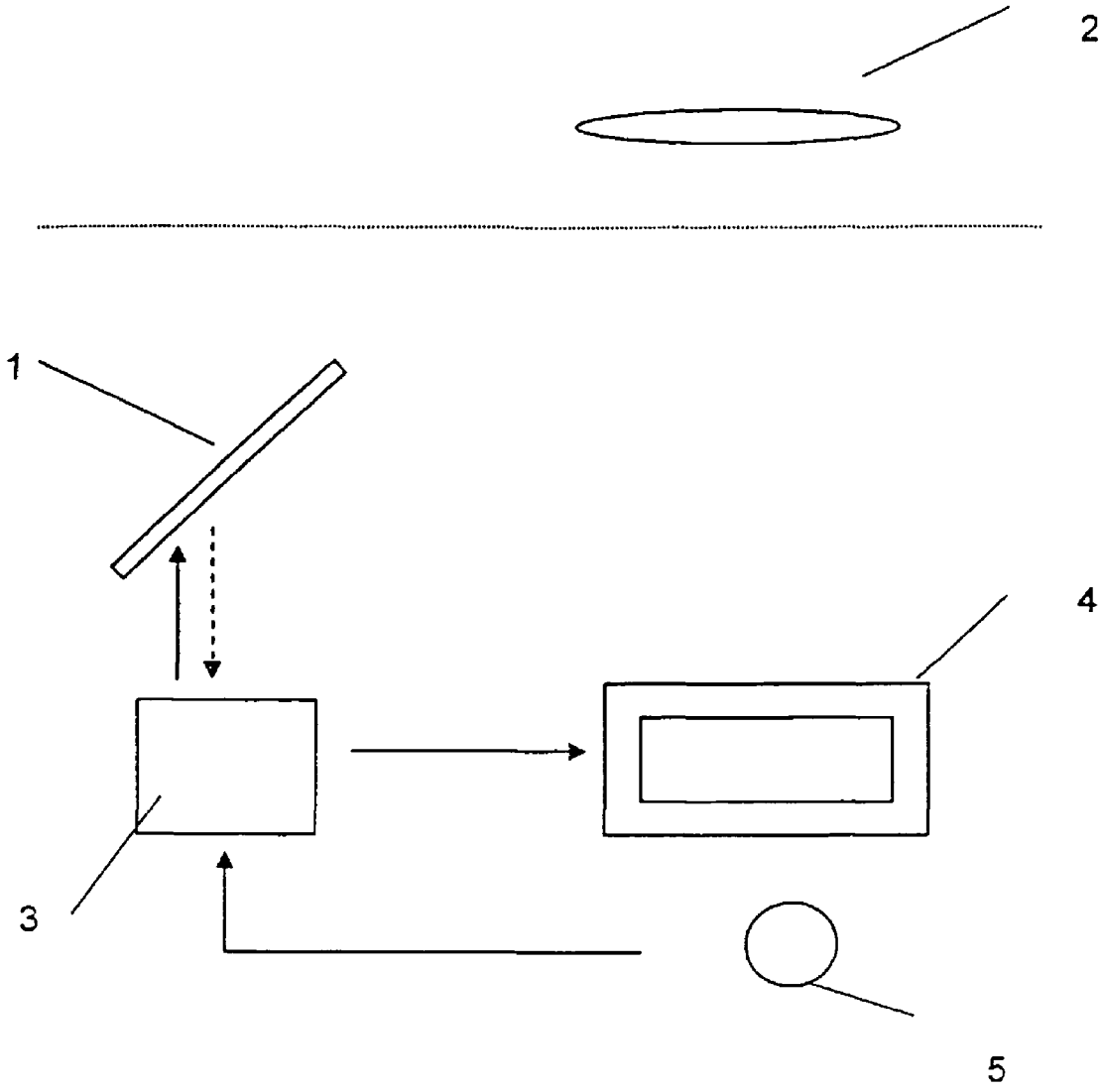
FIG. 1 shows an illustration, in the form of a block diagram, of the means required for the method.
Figure 2:
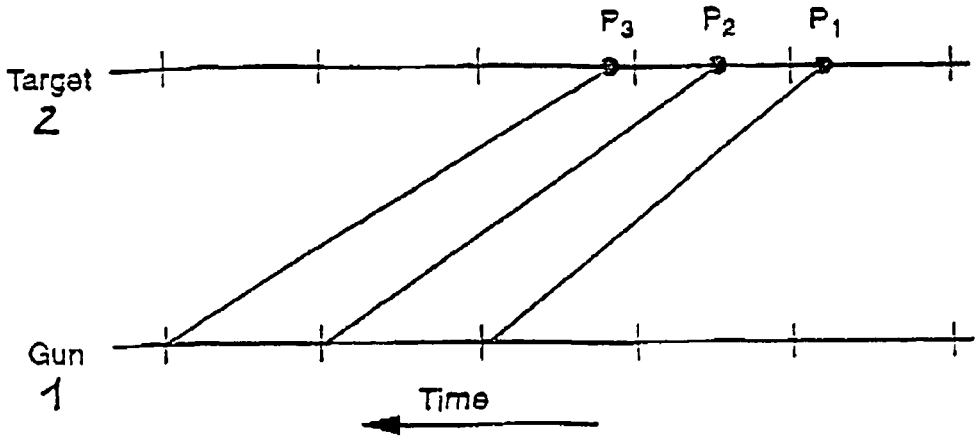
FIG. 2 shows an illustration of a firing burst, in the form of a graph.

FIG. 1 shows a gun, which is annotated 1, can be aimed and is attacking a target 2 with data supplied from a computer 3. The computer 3 is electrically connected to the gun 1 as well as to a display unit 4 for an operator 5. The target measurements are normally synchronized to the basic fire control clock cycle in the computer 3, which is generally the fire control computer, so that they do not coincide with the predictable hit points P1-P3. FIG. 2 shows a part of a firing burst. A gun 1, which is not itself illustrated in any more detail, fires at an approaching target 2 at regular intervals. The time of flight to the target 2 in the illustrated example is two to three firing cycles. Before the target offsets are calculated, the data is combined in time by means of suitable interpolation. The gun data is stored at least for the duration of the projectile time of flight. The target movement results in a certain extension of the time, so that no target measurements or a plurality of target measurements occur between two shots, and this is taken into account in the data processing.

Figure 3:
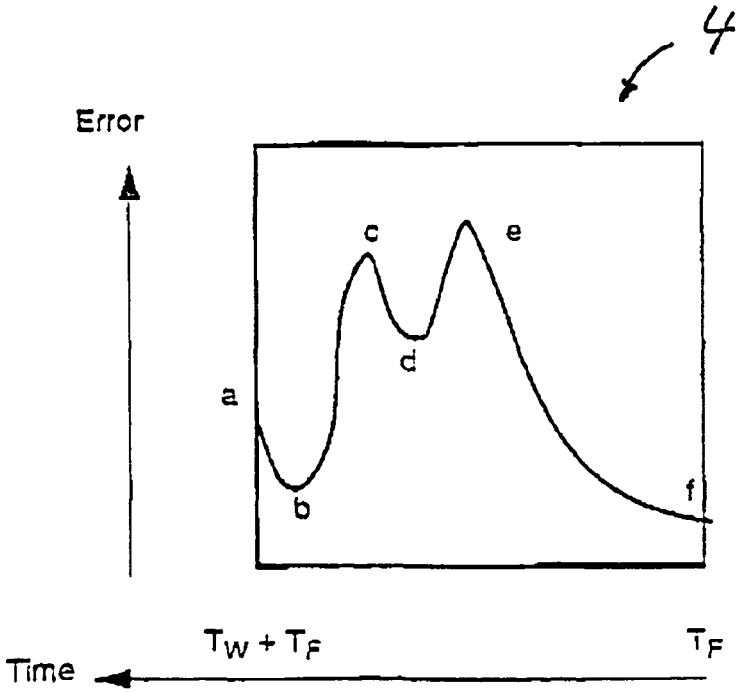
FIG. 3 shows an illustration of the calculated target offsets in a time window.

FIG. 3 shows one possible application of the calculated target offsets in a time window of duration $T_W$($T_W$=time window) which can be displayed on the display 4. In this implementation, the data is displayed in the form of a graph as a curve 6 moving to the left. The age of the most recent data is equal to the time of flight, and is plotted (f) on the right-hand side of the window. The older data whose age is $T_W+T_F$ (TF=projectile time of flight) disappears from the window at its left-hand edge (a). The higher the curve 6 is, the greater the hit error would have been at that time if a shot had been fired. As can be seen from this illustration, there was a good but short opportunity at the (b) while the times (c) and (e) would have been particularly poor. For this purpose, the error relating to the current time (f) has stabilized at a low value, so that the operator 5 could advantageously initiate firing, achieving a higher hit accuracy.

In order to improve the old data $T_F$, additional information is preferably included in the method, providing the operator 5 with other relevant information of a more recent origin, in order that the operator 5 can determine whether the time would also have been correctly chosen bearing in mind $T_F$.

Figure 4:
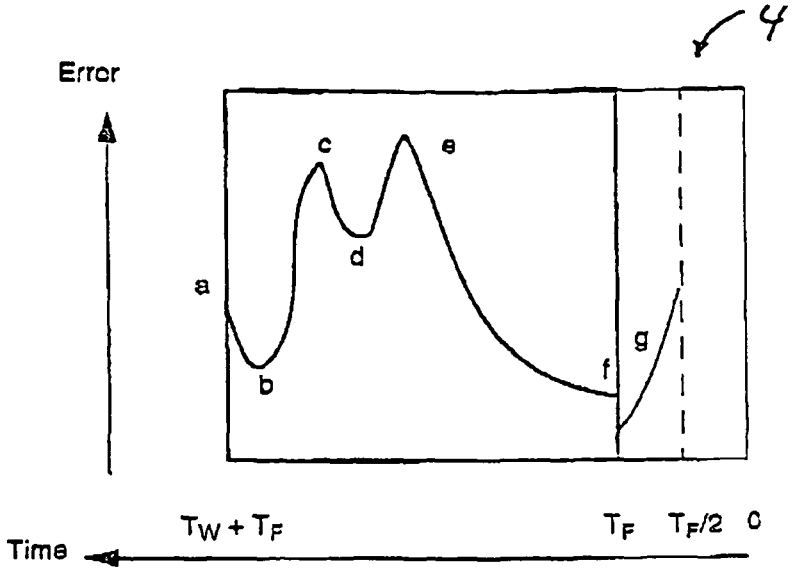
FIG. 4 shows the same illustration as FIG. 3, with first additional information.

For this purpose, in a first variant, the operator 5 is additionally provided with data in the form of a graph with $T_F/2$ as the curve element (g) (See FIG. 4). The curve element (g) in the illustrated example indicates that this moment is not good, as was assumed on the basis of FIG. 3, since the hit errors are rising again.

A further source for additional data, which is not illustrated in any more detail, may be the estimated accelerations from the filter. These are updated continuously with the aid of the latest target measurement.

Figure 5:
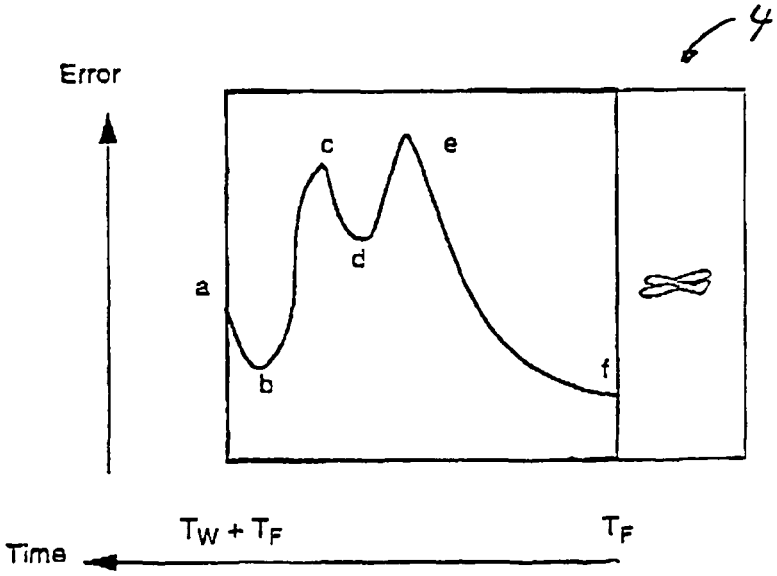
FIG. 5 shows the same illustration as FIG. 3, with further additional information.

Alternatively, the target (i.e. an aircraft) 2 may be observed directly. Before an aircraft 2 carries out a maneuver, it must change its attitude relative to the direction of flight. In this case, as is illustrated in FIG. 5, a video image of the target 2 can be overlaid on the display diagram on the display 4. This likewise provides current data and additional information which is taken into account by the operator 5 in order to assist him in the choice of the best moment to initiate firing.

The graphics displays as shown in FIG. 3 to 5 therefore assist the operator 5 in interpreting this display data such that it can use the trend of the profiles to deduce the future development of the hit errors.

An alternative implementation of the invention is to automate the method by means of a suitable algorithm in order to display the result in a simpler form, for example by means of a lamp or for self-initiation of firing by an appropriate firing command.

The invention claimed is:

1. A method for determining an advantageous moment for firing initiation at moving targets, wherein firing commands and hit points to be expected by a projectile with the target are calculated by means of an algorithm from an actual firing without actually having to initiate a firing burst, comprising the steps of:

searching for the target, applying said algorithm to said target to determine data hypothetically, said data being the continuous calculation and collection of firing commands and predicted hit points of hypothetical projectiles associated therewith, determining actual target position, after a calculated flight time of each hypothetical projectile, calculating a miss distance between the target and a previously calculated hit point, resulting in a statement as to how accurate each hypothetical projectile would have been, and indicating an advantageous moment for initiating firing when said calculated miss distance is stabilized at a low value.

2. The method as defined in claim 1, wherein the indicating step includes displaying the data graphically and on a display.

3. The method as defined in claim 2, including producing the graphic display with visible development of the miss distance.

4. The method as defined in claim 2, including using graphic curves over the time which corresponds to a correlation time of the response.

5. The method as defined in claim 1, including using real and current, or quasi-current, additional information.

6. The method as defined in claim 5, including additionally making data available graphically with $T_F/2$ as a curve element, wherein $T_F$ is projectable flight time.

7. The method as defined in claim 5, including using estimated accelerations, and continuously updating the accelerations with the aid of the latest target measurement.

8. The method as defined in claim 5, further including displaying the data graphically and on a display and overlaying a video image of the target on the display diagram on the display.

* * * * *

UNITED STATES PATENT AND TRADEMARK OFFICE

CERTIFICATE OF CORRECTION

PATENT NO. : 8,579,194 B2
APPLICATION NO. : 11/991229
DATED : November 12, 2013
INVENTOR(S) : Boss et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1347 days.

Signed and Sealed this
Twenty-second Day of September, 2015

Michelle K. Lee

Michelle K. Lee
*Director of the United States Patent and Trademark Office*